US005988600A

United States Patent [19]

Vento

[11] Patent Number: 5,988,600

[45] Date of Patent: Nov. 23, 1999

[54] MULTI-STAGE AERATOR

[75] Inventor: Thomas Joseph Vento, Tarpon Springs, Fla.

[73] Assignee: Keepalive, Inc., Tarpon Springs, Fla.

[21] Appl. No.: 08/974,086

[22] Filed: Nov. 19, 1997

[51] Int. Cl.[6] ..... B01F 3/04

[52] U.S. Cl. ..... 261/29; 261/93; 261/121.2

[58] Field of Search ..... 261/28, 29, 37, 261/93, 121.2, DIG. 75; 43/55, 57; 114/255

[56] References Cited

U.S. PATENT DOCUMENTS

| | | | |
|---|---|---|---|
| 2,246,559 | 6/1941 | Weinig | 261/93 |
| 2,246,560 | 6/1941 | Weinig et al. | 261/93 |
| 2,577,095 | 12/1951 | Walker | 261/93 |
| 3,806,452 | 4/1974 | Walker | 261/93 |
| 4,193,949 | 3/1980 | Naito | 43/57 |
| 5,213,718 | 5/1993 | Burgess | 261/121.2 |
| 5,582,777 | 12/1996 | Vento | 261/93 |
| 5,643,503 | 7/1997 | Roland | 261/93 |
| 5,711,902 | 1/1998 | Hsu | 261/93 |

*Primary Examiner*—C. Scott Bushey
*Attorney, Agent, or Firm*—Pendorf & Cutliff

[57] ABSTRACT

A high efficiency impeller-type aerator designed for aeration of the water supply of aquatic organisms. The aerator design includes a first impeller (booster), a second impeller (main impeller), and a pump casing having at least one water inlet, one air inlet, and one water outlet. The first and second impellers are disposed between the pump casing water inlet and outlet. The air inlet is positioned advantageously between the first impeller and the second impeller and is in communication with air, and wherein the water inlet and outlet are in communication with water. The efficiency of the pump is retained while the bubbles produced in accordance with the present invention are advantageously small.

12 Claims, 6 Drawing Sheets

MULTI-STAGE AERATOR

BACKGROUND OF THE INVENTION

1. Field of the Invention

The present invention is directed to a high efficiency impeller-type aerator for oxygenating the water supply of aquatic organisms, such as fish in a fish tank or bait in a live well.

2. Description of the Related Art

When fishing from a boat, it is a common practice to bring along bait fish in closed tanks known as live wells. Alternatively, larger boats may be equipped with a thru-hull bait well, wherein water from outside the boat is continuously pumped in, is passed through the tank, and is discharged over the side. In order to keep the bait fish alive for long periods of time, an aerator is provided to replenish the oxygen in the water as it is depleted by the bait fish. Several distinct types of aerators have been developed.

For example, U.S. Pat. No. 3,822,498 teaches an aerator for a live well wherein water is sucked through a pump and sprayed out a distributor manifold in the form of small jets above the surface of the water. As the jets pass through the air and then strike the surface of the water, the water picks up dissolved oxygen and entrained air bubbles. These systems are, however, disadvantageous for a number of reasons.

First, it is inevitable that jets of water will strike the fish and wash away the mucus outer coating which protects the fish. Second, energy consumption is high. Third, while the surface area of the live well may be aerated, the lower reaches of the bait well are not aerated, particularly when a large number of bait fish are kept in the bait well. Finally, aeration efficiency is relatively low, so that the total number of bait fish which can be kept in the well is correspondingly limited.

The aerator described in U.S. Pat. No. 5,582,777 (Vento et al), which utilizes a centrifugal pump, achieves a significantly improved level of oxygenation of the water in a live well while producing a gentle action which does not harm the bait fish. In fact, the unusually high level of oxygenation makes it possible to pack two to four times as many bait fish into a live well as had previously been possible.

The Vento et al use of the impeller cavity of a centrifugal or impeller type pump as an aerator mechanism represented a departure from conventional thinking, since it is the common experience of those in the industry that as air is introduced into the centrifugal pump it accumulates around the impeller, resulting in air-lock. That is, the accumulated air causes the impeller to spin freely, without pumping water. When water is not pumped through a live well, bait fish begin dying. Thus, conventional thinking was to take measures to prevent any air from getting into the centrifugal pump. Vento et al discovered that by regulating the amount of air introduced to the upstream (suction) side leading to a centrifugal pump, it becomes possible to induce a very thorough mincing of air and water in the pump impeller, resulting in emission of very fine mist of bubbles from the downstream (emission) side of the pump, without the problem of loss of suction. In other words, by supplying just the right proportions of air and water into the pump impeller, significant aeration can occur without the above-described problem of air lock.

Although the level of aeration is significantly improved with the Vento et al aerator as compared to conventional pumps using the same amperage, the inventor has noticed that there are two problems associated with this system. The first is that the Vento et al arrangement requires regulation of the input of air, either manually (via valve, clamp, etc.) or automatically (via optical turbidity sensors, etc.). The second is that the output from a centrifugal pump, once modified to introduce air according to the Vento patent, drops dramatically, for example, from 500 gallons per hour to 200 gallons per hour, thus the pump is operating at only 40% of its intended capacity.

In view of the foregoing, it is an object of the present invention to provide an improved centrifugal type aerator which does not require monitoring or regulating of the air input.

It is a further object of the present invention to provide an aerator which exhibits an improved capacity or flow rate.

It is a further object of the present invention to provide an aerator designed to avoid vapor lock of the centrifugal pump impeller.

It is yet a further object of the present invention to provide an aerator which achieves a high level of oxygenation.

SUMMARY OF THE INVENTION

The present inventor has investigated and experimented with various aerators and pumps, and produced what represents a significant improvement over the aerator invented previously by the present inventor, and which was described in U.S. Pat. No. 5,582,777 (Vento et al).

The present invention is built upon the Vento et al concept of introduction of air into the upstream (suction) side leading to a centrifugal pump, such as a conventional rotary bilge pump, to cause churning and a very thorough mincing of air and water in the impeller cavity, followed by output of a mist of very fine bubbles from the downstream (emission) side discharged from the centrifugal pump. On closer examination of the Vento et al device, the present inventor discovered and began investigating the problem of the significant inefficiency of the Vento et al aerator.

After extensive and careful experimentation, the present inventor found that centrifugal pumps are designed to pump a non-compressible fluid, such as water. The energy imparted to the impeller blades is normally used to move the impeller blades against water to cause flow of water through the impeller cavity, developing a negative pressure or suction on the upstream side and a positive pressure or discharge head on the downstream side.

However, once air is introduced into the impeller cavity, the impeller energy is diverted to first expanding air in the negative pressure side of the impeller, and then re-compressing air on the downstream side of the impeller. Further, as the volume of air is increased (due to the negative pressure) on the inlet side, this expanded air displaces water, reducing the amount of water sucked into the impeller cavity. As the air exits the impeller cavity it is compressed to reduced volume, this constant compressing having the end effect of reducing the output at the downstream side of the impeller. Thus, the conventional centrifugal pump, when used to pump a fluid containing a compressible gas, works harder to pump less fluid.

Following further experimentation, the present inventor was able to determine that the above problems could surprisingly be solved by placing a first stage or booster impeller before the second stage or main impeller, with air being introduced at a point downstream of the first stage impeller outlet and upstream of the second stage impeller outlet.

Specifically, a preferred aerator of the present invention, designed for aeration of the water supply of aquatic organisms, can comprise: a centrifugal type pump comprising a first impeller having inlet and outlet edges, a second impeller having inlet and outlet edges, and a pump casing having at least one pump water inlet, one pump air inlet, and one pump water outlet, with the first and second impellers disposed between the pump water inlet and outlet, wherein the air inlet is positioned between the first impeller outlet edge and the second impeller outlet edge and is in communication with air, and wherein the water inlet and outlet are in communication with water.

Alternatively, the aerator may comprise first and second water pumps, each having a water inlet and a water outlet, with the water outlet of the first pump in fluid tight communication with the water inlet of the second pump, at least the second pump being a centrifugal pump including an impeller having inlet and outlet edges, the first pump being a smaller capacity pump than the second pump, and an air inlet positioned between the first pump outlet and the second pump impeller outlet edge and in communication with air.

Operationally, the device of the present invention has two stages: the boost stage and the main stage. The main stage is similar in construction to the Vento et al device, but it's operation is modified by the pressure increase brought about in the boost stage. In the boost stage, water is drawn into the eye of the first impeller, or booster impeller, and is accelerated and thrown out, radially, at the impeller's outlet edge. In the main stage, air from the air inlet and pressurized water from the booster impeller are co-mingled or minced by the main impeller. Due to the increase in water pressure brought about by the booster impeller, the main impeller does not have to draw as hard on water, i.e., does not have to create a significant negative pressure gradient prior to the main impeller inlet. Since the negative pressure gradient is reduced, the air bubbles being introduced do not expand to the degree experienced in the original Vento et al device. Thus, the main impeller is not expending energy on expanding air. Further, since the air being introduced into the main stage is more compressed and less expanded, the air displaces less water, and the pumping capacity of the main impeller is significantly improved. Finally, since air is not being introduced to the booster impeller, and since the booster impeller is continuously providing water to the main impeller, i.e., is continuously priming the main impeller, it becomes impossible to "vapor lock" the main impeller. Thus, there is no need to monitor or control the aerator of the present invention to prevent vapor lock.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other aerators for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention reference should be made by the following detailed description taken in with the accompanying drawings in which.

DETAILED DESCRIPTION OF THE INVENTION

Figure 1:
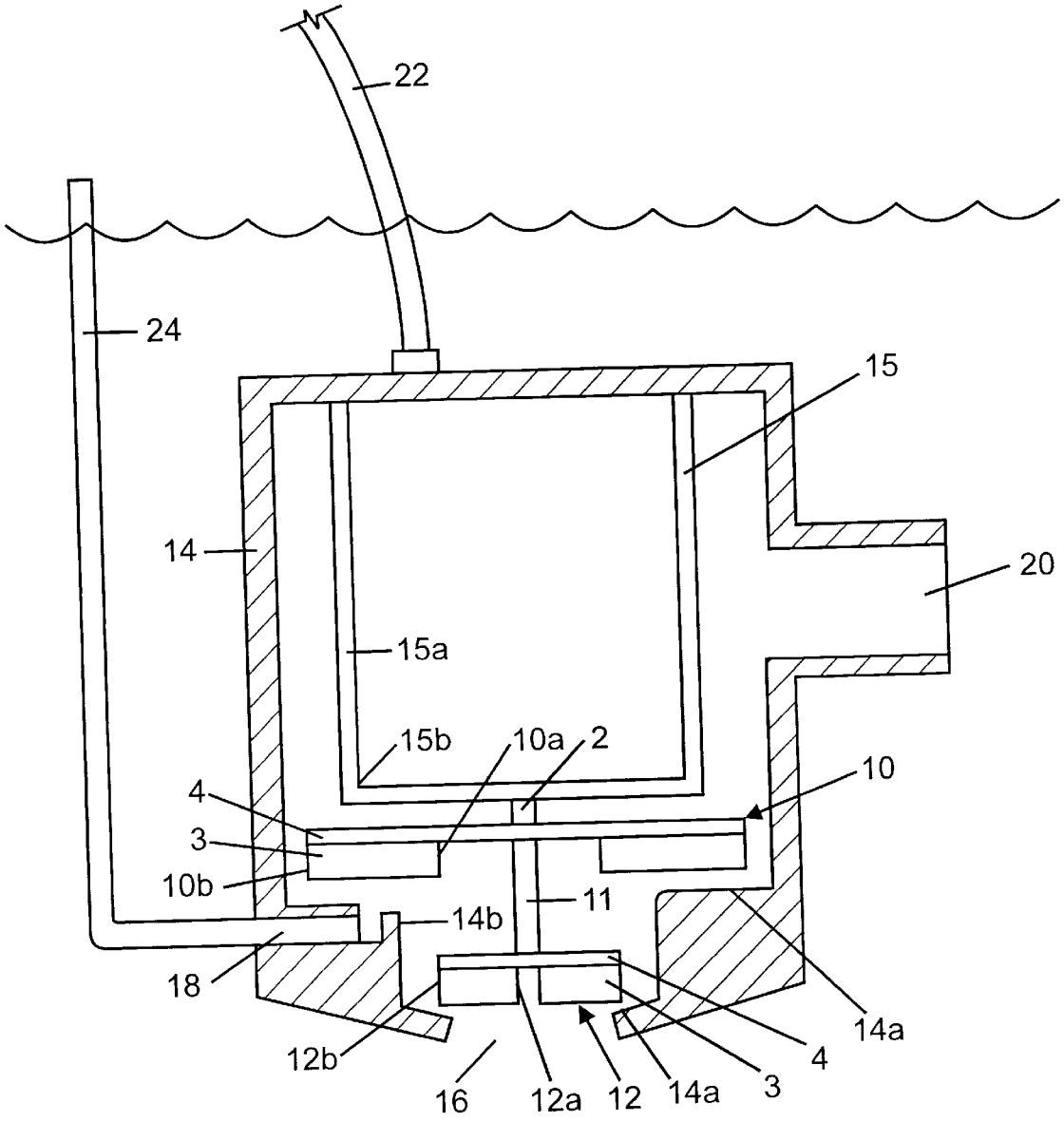
FIG. 1 shown is a cross-sectional view of a preferred design of the aerator of the present invention.
Figure 1A:
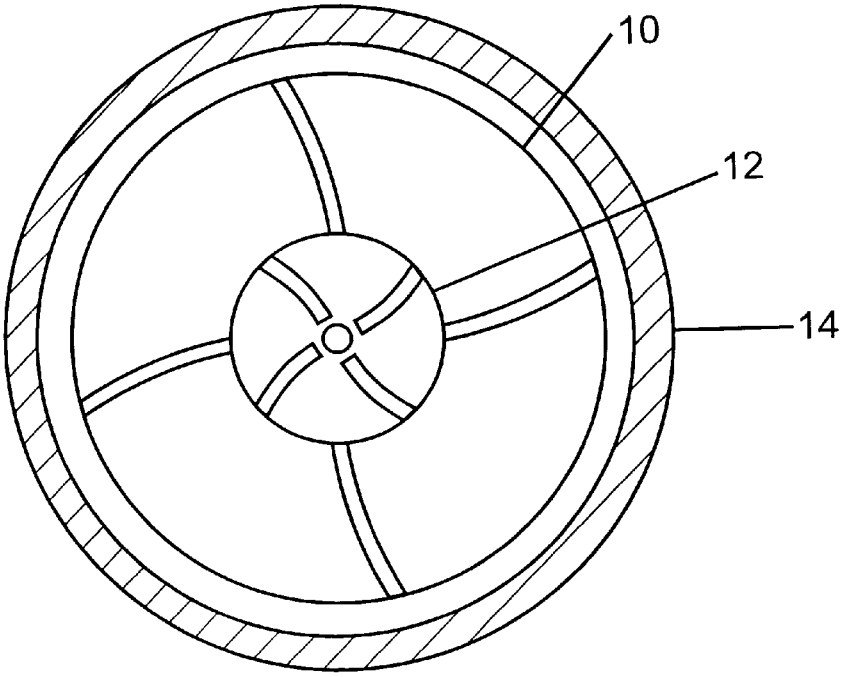
FIG. 1A is a top view of the first and second impeller blades.

The present invention is directed to an aerator for oxygenating the water supply of aquatic organisms, particularly for a live bait well or a boat's thru-hull bait well. As used herein, the terms aerator and oxygenator have the same meaning.

While the present invention represents a marked improvement over the aerator described in U.S. Pat. No. 5,582,777, the basic technology remains the same. Specifically, the present invention remains based upon the discovery that the introduction of air into an upstream side (suction) leading to a centrifugal pump such as a centrifugal rotary bilge pump as well known in the art, results in the ability to optimize the air/water mixture, resulting in a very fine mincing of air and water. The pump discharges an air/water mixture containing a large volume of very fine air bubbles.

These fine air bubbles are significantly better at oxygenating water than larger air bubbles as produced by conventional aerators since (1) the effective bubble surface area and thus air/water contact area is increased, (2) smaller bubbles take much longer to rise to the surface and thus remain in the water longer, (3) smaller bubbles are less likely to coalesce upon contact, and thus are likely to remain suspended in the form of fine bubbles, and (3) the presence of the ultra-fine bubbles during the mechanical churning during pumping has a synergistic effect resulting in enhanced oxygenation.

The term "centrifugal pump" as used herein is intended to mean a pump which utilizes the throwing force of a rapidly moving impeller. The liquid is pulled in at the center or eye of the impeller and is discharged at the outer rim of this impeller. By the time the liquid reaches the outer rim of the impeller, it has acquired considerable velocity. The liquid is then slowed down by being led through either a volute or a conical housing. The simplest method for converting dynamic pressure to static pressure is to slowly increase the volute delivery channel area (e.g., a taper of no greater than 8°). This is known as a diffuser and is often used on small pumps. As the velocity of the liquid decreases, its pressure increases. The shape of the outlet has the effect of changing the low-pressure, high velocity fluid to high pressure, low velocity. That is, some of the mechanical kinetic energy is transformed into mechanical potential energy. In other words, the velocity head is partially turned into pressure head.

The aerator of the present invention is characterized by the employment of two rapidly rotating impellers of a centrifugal pump—a first impeller, or booster, to draw in water and sustain a good vacuum, and a main impeller to mince air and water, the booster impeller priming the main impeller.

The precise manner in which the main impeller minces the air and water and creates the ultra fine air bubbles is not understood, but it is logical to assume that the rapid changes of direction from (1) axial at the eye to (2) radial in the impeller to (3) axial between the impeller tip and the outlet to (4) radial at the water outlet, and also the changes in speeds, pressures, shear forces, and other forces acting within the impeller have an effect on the formation of bubbles.

Specifically, and with reference to the figures, a preferred aerator 1 of the present invention, designed for aeration of the water supply of aquatic organisms comprises: a centrifugal type pump comprising a first impeller 12 (booster) having inlet and outlet edges 12A and 12B, respectively, a second impeller 10 (main impeller) having inlet and outlet edges 10A and 10B, respectively, and a pump casing 14 having at least one pump water inlet 16, one pump air inlet 18, and one pump water outlet 20, with the first and second impellers 12 and 10 disposed between the pump casing water inlet 16 and outlet 20, wherein the air inlet 18 is positioned between the second impeller outlet edge 10B and the first impeller outlet edge 12B and is in communication with air, and wherein the water inlet 16 and outlet 20 are in communication with water.

In all cases the impellers are operated under conditions under which no cavitation (as conventionally defined) occurs, i.e., there is no reduction in pressure to the point where the hydrodynamic pressure of the water is dropped to below its vapor pressure. Cavitation most frequently occurs in a marine environment when the vapor pressure of the water is dropped below the vapor pressure of air behind a ship's propeller blade, such that air bubbles are formed. Strictly speaking, cavitation can occur when the pressure in a container of carbonated beverage is reduced such that dissolved gasses come out of solution and form carbon dioxide "cavities". For the purposes of the present invention, no such cavitation occurs. The impeller is operated under conditions where a smooth, continuous mincing of air and water occurs.

The centrifugal pumps as used in the present invention are basically similar to a wheel, with vanes or blades called impeller blades sandwiched between an upper and a lower housing. For ease of construction, one of the upper or lower impeller housings may be eliminated so long as the free upper or lower sides of the impeller blades are in close proximity to the impeller chamber housing. An impeller thus differs from a propeller mainly in that (1) an impeller operates using centrifugal force, while a propeller does not, and (2) an impeller has a upper and lower housing or case for throwing fluids out radially, while a propeller has only blades which pushes liquid in a direction axially parallel with the propeller shaft. A propeller type pump can not achieve the ultra-fine bubbles according to the present invention.

An impeller may be of either the centrifugal pump type or the compressor type, with centrifugal pump type impellers being greatly preferred. Pump impellers are generally cast in one piece with a hub; compressor impellers are generally fabricated.

As shown in FIG. 1, the aerator 1 further comprises a water impermeable motor casing 15. An electric motor (not shown) of any conventional design is mounted within the motor casing 15. The electric motor may be of any suitable construction such as the type utilized in a RULE bilge pump, for example, a RULE 360 GPH bilge pump. Basically, any conventionally available centrifugal pump motor available in the fishing industry can be used for the purposes of the present invention. A major supplier of pumps containing such motors is E&B Discount Marine, Inc. of 201 Meadow Road, P.O. Box 3138, Edison, N.J., as found in the E & B Discount Marine, Inc. Catalog '95, pages 112–115 of which are incorporated herein by reference. The motor may be powered by any suitable means such as an internal battery, an external portable battery, or via electrical connections to the main electrical supply system of a boat (in which case the electric drive motor includes insulated electrical conductors 22). The ends of the electrical connection means 22 may be provided with electrically conductive clamps (not shown) whereby the clamps may be clamped to the terminals of an electric battery or other source of electrical power. The portable power supply (not shown) may be provided in a casing which can be mated integral with the motor casing 15, or may be located outside the motor housing and inside or outside the bait well, in which case external electrical connection means 22 are again required.

Figure 1B:
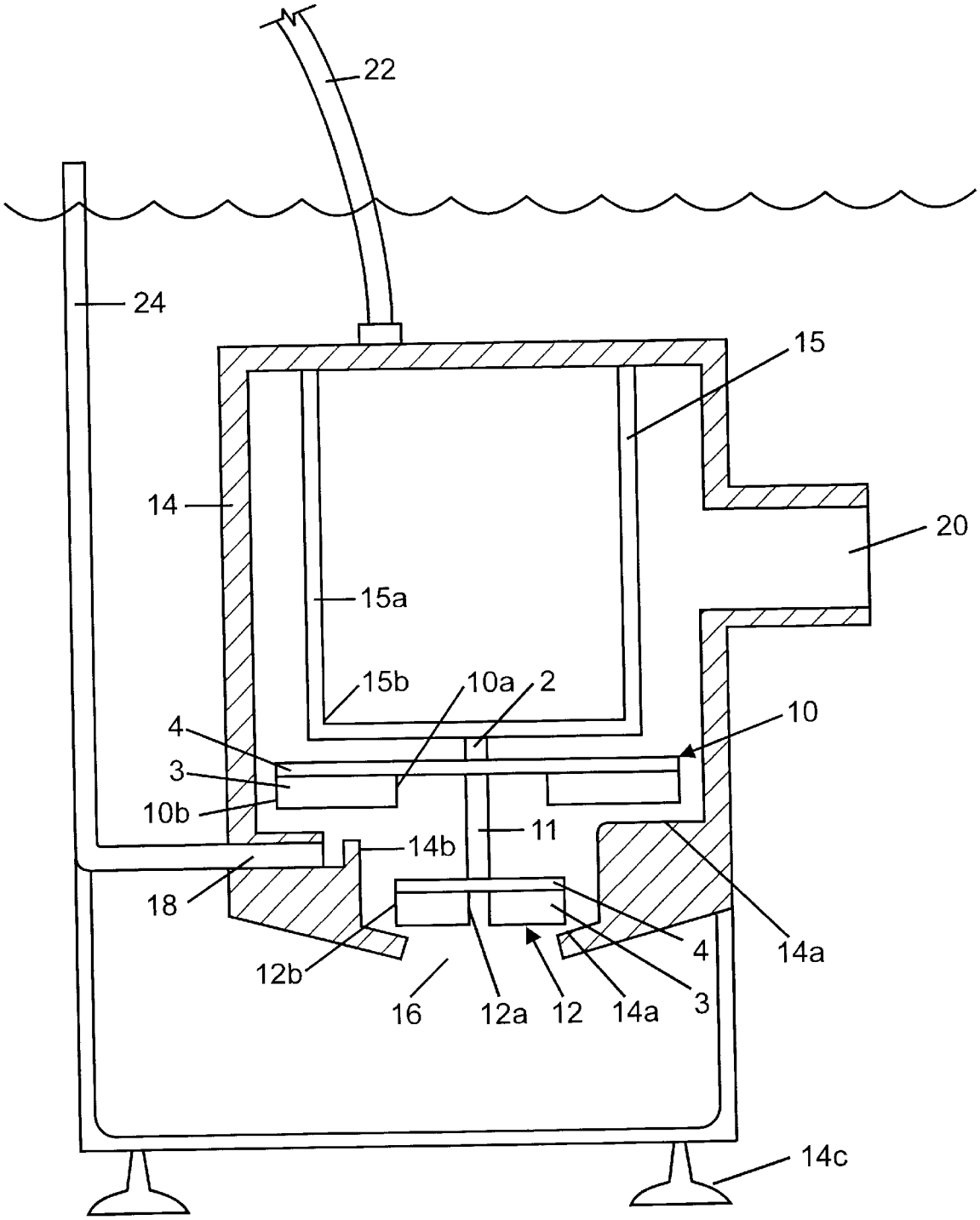
FIG. 1B is a cross-sectional view of the preferred design of the aerator of the present invention having suction cups.

The assembly may then be placed into the live bait well or thru-hull well and anchored to the bottom thereof via suction cups 14C as depicted in FIG. 1B.

A drive shaft 2 extends through the bottom of the motor casing 15 and is connected to the second centrifugal rotary impeller, or main impeller 10. Preferably, for ease of assembly, the main impeller 10 and booster 12 are integrally molded as one article. Therefore, the main impeller 10 and booster 12 are connected by a hollow sleeve 11. The drive shaft 2, therefore, extends through the hollow sleeve 11, and is affixed to it, so that when the motor turns the drive shaft 2, both impellers 10 and 12 are likewise turned.

Figure 2:
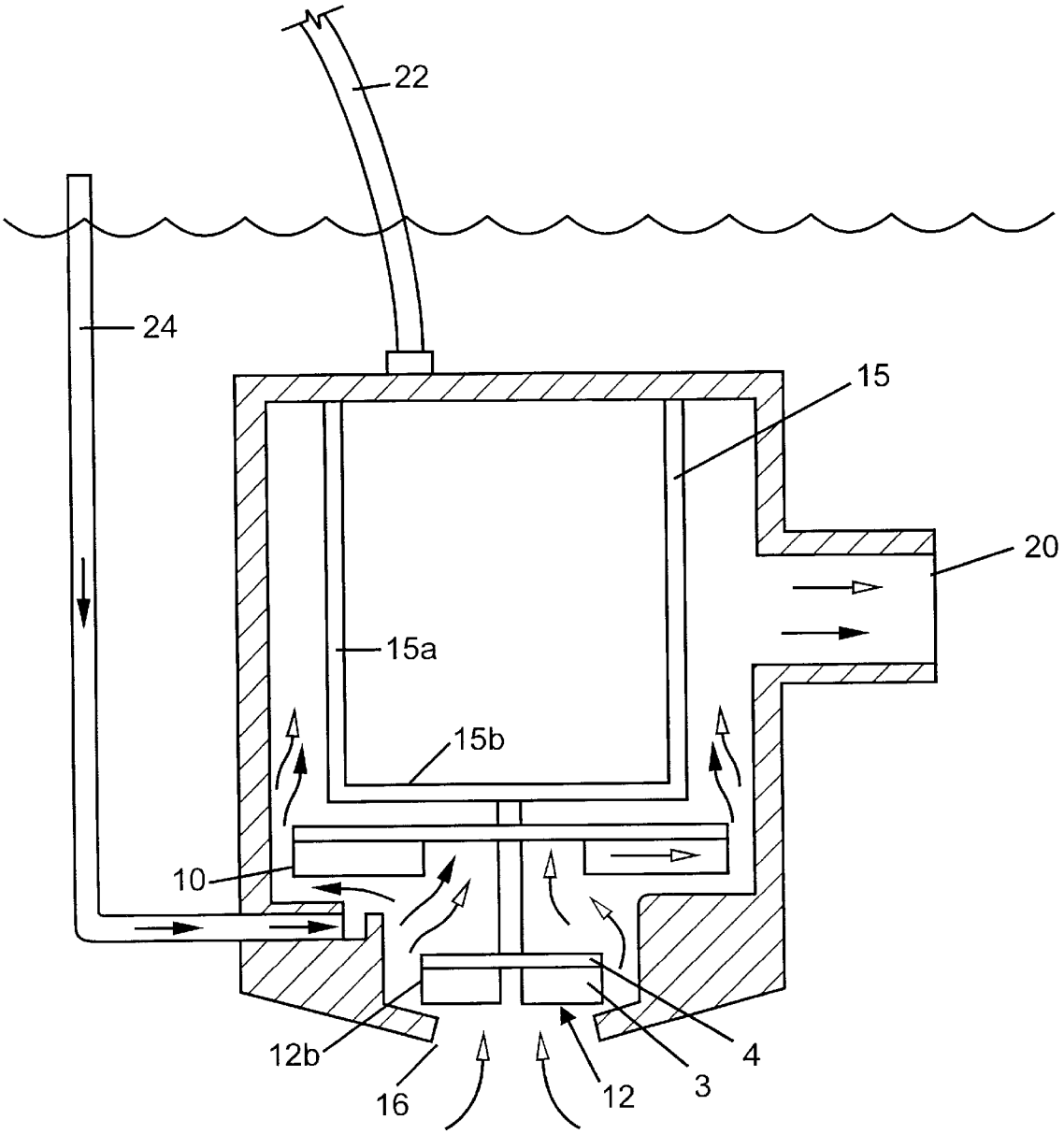
FIG. 2 shown is a cross-sectional view of the preferred design of the aerator of the present invention showing its operation.

The pump casing 14 and motor casing 15 cooperate to direct water flow as shown in FIG. 2. This is facilitated by the preferred shape of the motor housing 15, which comprises a generally cylindrical outer wall portion 15A and a generally flat bottom portion 15B. The pump casing 14 is shaped so as to encompass the impellers 10 and 12 and to define water inlet 16 and water outlet 20 areas. Further, the pump casing 14 forms flat bottom portions 14A. In the design as shown in FIG. 1, preferably, the water inlet 16 is immediately below, and co-axial with, shaft 2, and also immediately below the "eye" of the booster 12. The lateral water outlet 20 is provided in the pump casing 14 above the main impeller 10 for return of aerated water to the bait well.

Each impeller 10 and 12 comprise a top disk-shaped impeller plate 4 which is fixed at its center to the drive shaft 2. The impellers 10 and 12 are provided with a plurality of impeller vanes 3. The vanes 3 extend downwardly and are in close tolerance with the surface of the pump casing 14. The top impeller plate 4 and the flat bottom portion 14A of the pump casing 14 thus define the axial flow directing boundaries of the impellers 10 and 12 through which the impeller vanes 3 urge the water. Specifically, the vanes 3 of the booster 12 define the booster's pump inlet edge 12A and pump outlet edge 12B. The vanes 3 of the main impeller 10 define the main impeller's pump inlet edge 10A and pump outlet edge 10B. During operation, water flows within the booster's inlet edge 12A, into the booster's "eye", and is expelled at the booster's outlet edge 12B. The centrifugal type pump of the present invention operates at a capacity of 500 gallons per hour but the aerator design may be sized to have greater pump capacities. Simultaneously, while the expelled water is drawn within the main impeller's inlet edge 10A, into the main impeller's "eye", air is also pulled from the air inlet 18 and pulled within the main impeller's inlet edge 10A, into the main impeller's "eye". The air and water are minced in the main impeller 10 and expelled at the main impeller's outlet edge 10B.

It is preferable that the vanes 3 of the booster 12 describe a curve because they are only involved in the movement of water. In contrast, it is preferable that the vanes 3 of the main impeller 10 be substantially flat to facilitate the mincing of air and water. It is also preferable that the booster 12 be approximately one third the size of the main impeller 10.

Referring now to the air inlet 18, FIG. 1 shows one possible arrangement of an air conduit 24. Air inlet 18 is shown as having an inner diameter of ⅛ inch corresponding to the ¼ outer diameter of the flexible air conduit 24, so that air conduit 24 can simply be inserted into air inlet 18 when it is desired to use the impeller pump as an aerator. Alternatively, the air conduit 24 can be disconnected from air inlet 18, in which case the impeller pump can be used as a conventional pump, such as for a bilge pump. Suitable retaining means for retaining the aerator at the desired location, preferably at the bottom of the bait well, is provided, such as a lead weight, a snap fitting, or even a suction cup (not shown) mounted to the flat bottom of pump housing 14, as described in U.S. Pat. No. 5,582,777.

As shown, the air conduit 24 is preferably a flexible transparent tube of a construction and material as readily available in pet stores for use in association with aquariums. The air conduit 24 and air inlet 18 may be of any diameter, so long as the opening of the air inlet 18 is within a critical range required for operation of the aerator. That is, if the diameter of the air conduit 24 is too large, the volume of air in the air conduit 24 will make it possible for the pump to oscillate or surge, alternatively drawing large bubbles and then no air into the impeller. Further, if the diameter of the air conduit 24 is too small, a sufficient supply of air to the main impeller 10 for optimal oxygenation is not always possible. This is not conducive to the production of fine bubbles and the smooth operation of the aerator.

The air conduit 24 has an opening in communication with the air, which opening is preferably above the fluid level of the bait well, but which may extend, e.g., out the side or bottom of the well. The lower outlet of the air conduit 24 supplies air to the air inlet 18 of the pump housing 14.

It should further be understood that the air conduit 24 and air inlet 18 may engage via intermediate tubing (not shown), as described in U.S. Pat. No. 5,582,777 and referred to therein as "conduit", the disclosure of which is herein incorporated by reference. The intermediate tubing may be of varying embodiments as described in Vento, et al.

It can be seen that the air inlet 18 functions to supply air from air conduit 24 as close to the eye of the main impeller 10 as possible. It is critical to oxygenation and optimal pump capacity that the air inlet 18 be positioned between the booster's outlet edge 12B and the main impeller's outlet edge 10B. The reason that the air inlet 18 does not supply air closer to the eye of the main impeller 10 is that it is necessary to maintain a wall, or water boundary 14B in which to guide the water expelled from the booster 12 towards the eye of the main impeller 10 and to create the venturi effect to pull air from the air inlet 18.

The approximate relationship between the essential components shall now be described. In its simplest form, air inlet 18 is approximately ¼ inch in diameter. As can be seen, the space between the impeller blades 3 and bottom flat portions of the pump housing 14A is very small, preferably even smaller than shown by the drawings. The horizontal separation between the top of the impeller vanes 3 and the plane of the bottom portions of the pump housing 14A is preferably within ¼ of the diameter of water inlet 16, more preferably within ⅙ the diameter of the water inlet 16, and most preferably within 1/10 of the diameter of the water inlet 16, in the case that the pump is horizontal.

The operation of the aerator will now be described with reference to the drawings. As seen in FIG. 1, when the electric motor (not shown) is energized, drive shaft 2 rotates causing corresponding rotation of the main impeller 10 and booster 12 whereby water is drawn into the water inlet 16, is accelerated by the impeller vanes 4 of the booster 12, and is slung out at its outlet edge 12B at which point the water has achieved maximum velocity. The activity up to this point describes the boost stage of the pump. The following describes the main stage of the pump. The water is redirected upwardly, preferably by the water boundaries 14B of the pump housing 14 and is drawn into the eye of the main impeller 10. While traveling axially upward, the velocity of the water is reduced and, as a consequence, the potential pressure is increased.

As the booster 12 begins to pump water in through the water inlet 16 and out through the water outlet 20, a reduced pressure or suction head will form at the water inlet 16. Once the absolute pressure at the water inlet 16 drops below the air pressure at air inlet 18, air enters through the air inlet 18 via the air conduit 24 and enters into the pump housing 14 at a point advantageously between main impeller 10 and booster 12, as discussed above. Again, the venturi effect which draws in air from air inlet 18 is facilitated by the water boundary 14B.

Optimal oxygenation of the water can be confirmed visually. An important principle of the present invention is that optimal oxygenation does not depend upon optimal air flow through the air conduit 24. Rather, optimal oxygenation depends upon the introduction into the bait well of very finely divided air, i.e., ultra fine air bubbles. The air bubbles should have the appearance of a fine mist or fog. The air bubbles are so small as to remain under water for a long period of time, and optimally saturate the water with oxygen.

To be viewed as an improvement over the single impeller aerator taught in Vento, et al., the air flow need not be controlled to achieve the maximum amount of the finest air bubbles.

The output from the pump is smooth and non-turbulent, so as to provide optimal habitation conditions for live bait, i.e., there is no surge, there is no high turbulence, and the flow is only so great as necessary for the recirculation of water and for the even distribution of oxygen throughout the live bait well.

As an option, a strainer (not shown) of any suitable construction is mounted on the bottom of the pump casing 14. The strainer merely serves to prevent bait fish from being drawn into the booster 12.

Of course, the aerator 1 may be placed in a portable bait container such as a "minnow buckets", placed within a bait well built into a boat, or even may be used as a temporary aerator for a fish aquarium. Further, the aerator may be used in any form of live box to aerate the water therein. Furthermore, the pump casing can have suction cup means 14C for attaching to the floor of the bait well or other support means.

One characteristic of the multi-stage two impeller aerator is an increased amount of heat generated by the motor due to the increased resistance produced by having two impellers turning the water. When the aerator of the present invention is mounted in a thru-hull mounting for a boat, as in the preferred embodiment, there is less risk of heat contaminating the water in the tank because the water is continually being replenished with water from outside the boat. However, when the aerator of the present invention is mounted in a live bait well, in which the water is being re-circulated, it is advantageous to include an air inlet and outlet in the motor casing 15, along with an impeller which functions exclusively to circulate air around the motor, cooling it. This alternative embodiment is shown in FIG. 3.

Figure 3:
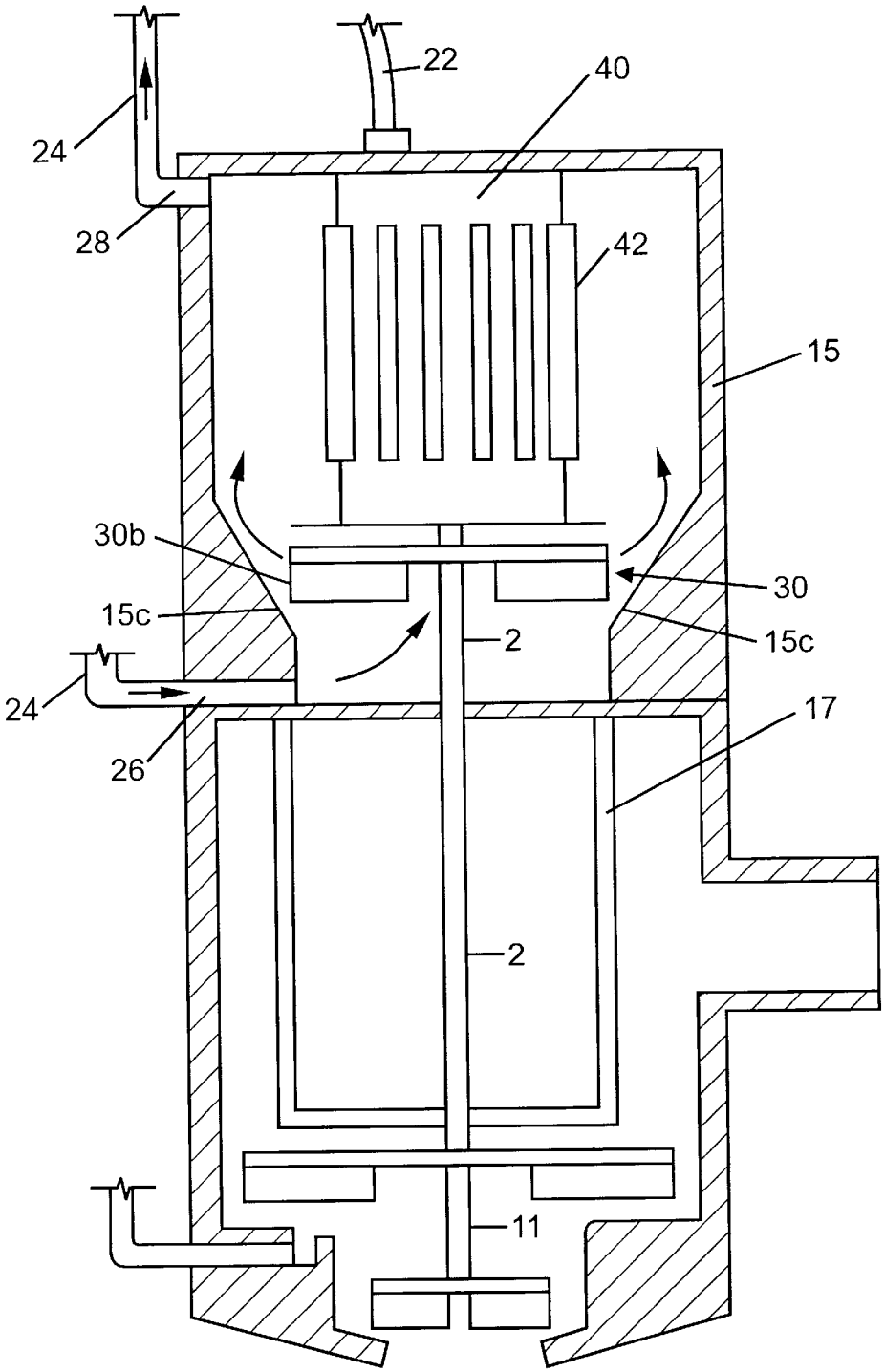
FIG. 3 shown is a cross-sectional view of the thru-hull embodiment of the aerator of the present invention.

As shown in FIG. 3, in the thru-hull embodiment, the motor casing 15 is external of the pump casing 14, and connected to the pump casing 14. It is for this reason that the motor casing 15 should again be water-tight. It is important to understand that an empty motor casing 17 still remains within the pump casing 14 to direct water flow toward the water outlet 20 and provide a surface in close proximity to the impeller plate 4 of the main impeller 10 in order to facilitate suction. To facilitate mass production of the thru-hull embodiment, the motor casing 15 merely engages with the live well embodiment, the live well embodiment having no motor within its motor casing 17. Further, preferably disposed upon the same drive shaft 2 that the main impeller 10 and booster 12 are disposed on, is disposed an air impeller 30. The air impeller 30 is identical in structural components to the main impeller 10 and booster 12. Because the impellers 30, 10, and 12, share the same drive shaft 2, when the motor 40 (which is shown only in FIG. 3) is operated, the drive shaft 2 rotates, thereby rotating the air impeller 30, the main impeller 10, and booster 12, simultaneously. As seen in FIG. 3, the drive shaft 2 extends from the motor 40, through the empty motor casing 17. The motor casing 15 defines an air inlet 26 and an air outlet 28. The air inlet 26 and air outlet 28, of course, are in communication with air via similar air conduit 24 to that used to engage pump casing's air inlet 18. It is preferable that the ends (not shown) of the air conduit 24, which are in contact with air, be sufficiently separated from each other to facilitate the drawing in of fresh, un-circulated (unheated) air. As shown in FIG. 3, in this embodiment the motor casing 15 further defines a taper 15C which functions to efficiently direct air from the air impeller's outlet edge 30B to the motor 40, so that the motor can efficiently be cooled. Preferably, the motor 40 defines aluminum cooling fins 42, which function to increase the surface area of the motor 40, and facilitate liberation of heat to the inside of the motor casing 15. It should be understood that the extra work required of the motor 40 to turn the air impeller 30 is negligible compared to the benefit received in the cooling effect produced by the air impeller 30.

Figure 4:
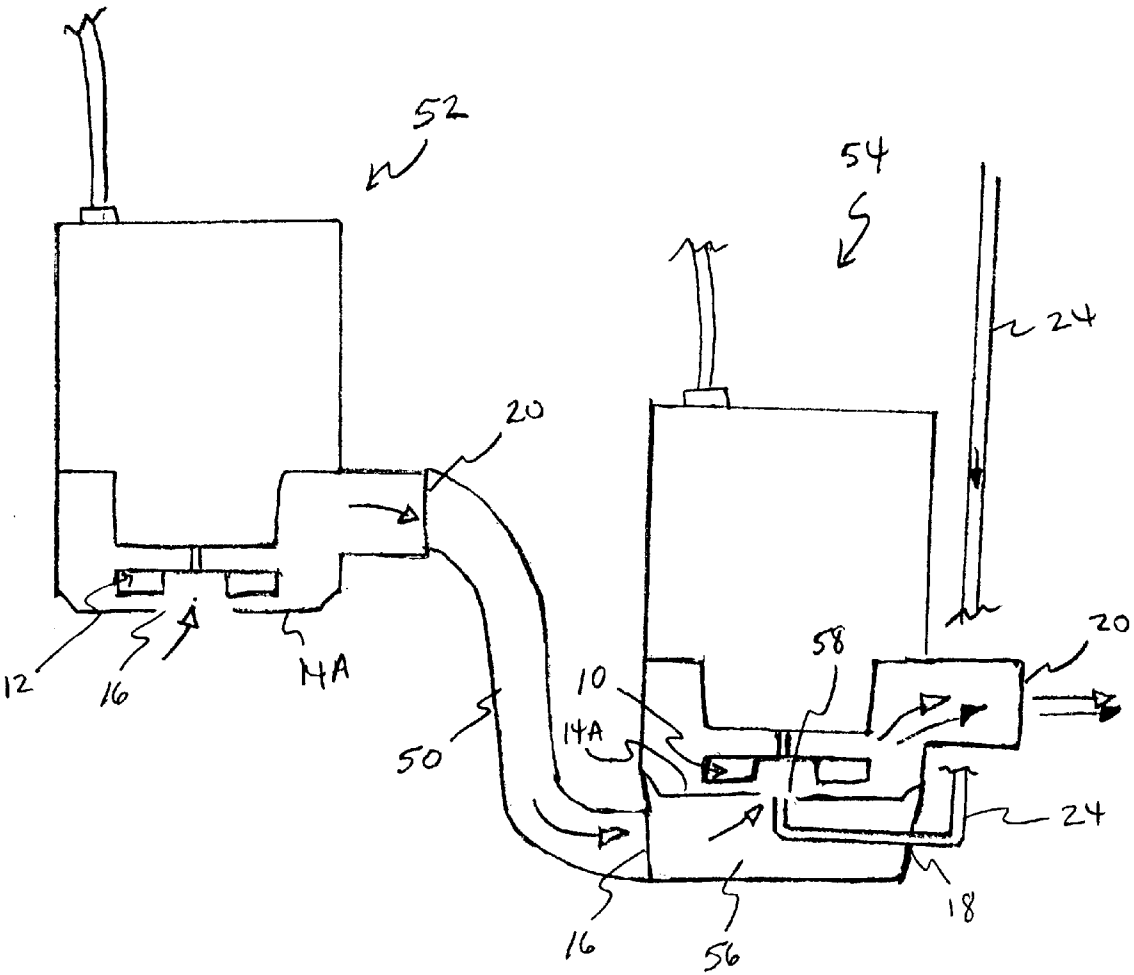
FIG. 4 shown is a cross sectional view of an alternative embodiment in which two pumps are oriented in series.

Referring now to FIG. 4, as an alternative embodiment, the aerator may comprise first and second water pumps 52 and 54, respectively, each having a water inlet 16 and a water outlet 20, with the water outlet 20 of the first pump 52 in fluid tight communication with the water inlet 16 of the second pump, at least the second pump 54 being a centrifugal pump including an impeller (shown generally in FIG. 4) having inlet and outlet edges 10A and 10B, the first pump 52 being a smaller capacity pump than the second pump 54, and an air inlet 18 positioned between the first pump outlet 20 and the second pump impeller outlet edge 10B and in communication with air.

In the alternative embodiment of FIG. 4, the impeller of the first pump 52 acts as the booster 12, while the impeller of the second pump 54 acts as the main impeller 10. Each impeller 10 and 12 is merely driven by two independent motors and housed within two pumps in fluid communication. Specifically, the water outlet 20 of the first pump 52 is in communication with the water inlet 16 of the second pump 54 via a water conduit 50. The water conduit 50 is preferably a plastic sufficiently durable to carry accelerated water from the first pump 52 to the second pump 54. Further, as shown in FIG. 4, it is preferable that the second pump 54 be positioned lower than the first pump 52 and that the water inlet 16 of the second pump 54 be defined laterally, so that the water pumped by the first pump 52 does not need to be pumped through the water conduit 50 in an upward direction. Both pumps 52 and 54 define flat lower surfaces 14A to facilitate suction produced by the impellers 10 and 12. Further, the second pump 54 defines a deliver chamber 56. Defined laterally within the delivery chamber 56 are the water inlet 16, opposing air inlet 18, and a delivery aperture 58. Preferably, the air conduit 24 runs through the air inlet 18, terminating at the delivery aperture 58. The delivery aperture 58, which is located beneath the eye of the main impeller 10, is small in comparison to the second pump's water inlet 16, to facilitate suction by the main impeller 10.

It should be understood that, in the alternative embodiment of FIG. 4, the boost phase of the aeration process occurs within the first pump 52 and the main phase of the aeration process occurs within the second pump 54. As discussed, the second pump 54 has a larger capacity than that of the first pump 52, the water flow differential facilitating suction. For example, if the first pump 52 has a capacity of 500 gallons per hour, it is preferable that the second pump have a capacity of 700 gallons per hour.

Referring again to the aerator in general, the mixture of water and air which enters the impeller is violently agitated and leaves the outlet 20 of the impeller pump in the form of water with very fine air bubbles giving the appearance of fogging the water. In some cases the air bubbles may be so fine that it will be difficult to tell whether the pump is aerating or not. In that case, placement of a hand in front of the outlet 20 will either cause a rapid buildup of bubbles on the skin, showing that the aerator is working, or will result in no bubbles forming on the skin, in which case no aeration is occurring.

While a RULE 360 works well for large bait tanks as found on fishing boats, the amount of aeration would be too large for smaller bait tanks such as "guppy buckets". In that case, a correspondingly smaller capacity pump, such as a 40 gph pump, may be used.

Various structures and connections may be resorted to. All that is important is that air and water are intimately and violently minced within a second impeller, the second impeller being primed by a first impeller. The pump may be operated right-side-up (with the water inlet opening downwardly), up-side-down (with the water inlet opening upwardly) or sideways.

The invention is applicable to bait wells for fresh water fish as well as for salt water fish, though best results have been observed with salt water. The invention is not limited to bait wells, and is applicable to aeration of aquariums, lobster holding tanks, etc.

The aerator of the present invention is rather powerful and need not be run full time. The aerator may be energized cyclically in a pattern set by a timer. Alternatively, the aerator may be energized responsive to sensor input, such as oxygen saturation sensors, as discussed in, e.g., U.S. Pat. No. 5,320,068, which teaches a system for the automatic control of oxygenation for agriculture.

Although the aerator was first designed as an aerator for bait fish in a bait well, it will be readily apparent that the device is capable of use in a number of other applications, such as in mincing various liquids and gasses. Although this invention has been described in its preferred form with a certain degree of particularity with respect to an aerator, it is understood that the present disclosure of the preferred form has been made only by way of example and that numerous changes in the details of structures and the composition of the combination may be resorted to without departing from the spirit and scope of the invention.

Now that the invention has been described,

I claim:

1. An aerator device for aerating the water supply of aquatic organisms, said device comprising:

a centrifugal pump for pumping fluids, said pump comprising;

(a) a first impeller having an inlet edge and an outlet edge, (b) a second impeller having an inlet edge and an outlet edge, (c) a pump casing having at least one pump water inlet, one pump air inlet, and one pump water outlet, and (d) a fluid-tight means for driving said impellers, wherein said first and second impellers are disposed between said pump water inlet and outlet, wherein said first impeller is about one-third the size of said second impeller, wherein said pump air inlet is positioned between said first impeller outlet edge and said second impeller outlet edge and is in communication with air, and wherein said water inlet and outlet are in communication with water.

2. An aerator device as in claim 1, wherein said first impeller and said second impeller are coaxial and connected by a hollow cylindrical sleeve.

3. An aerator device as in claim 1, wherein the inner diameter of said air inlet is approximately ⅛ inch.

4. An aerator device as in claim 1, wherein said air inlet is engaged with flexible plastic tubing having an outer diameter of approximately ¼ inch.

5. An aerator device as in claim 1, wherein said aerator device is provided with suction cup means.

6. An aerator device as in claim 1, wherein the capacity of said centrifugal pump is 500 gallons per hour.

7. An aerator device as in claim 1, wherein said first impeller has vanes describing a curve.

8. An aerator device as in claim 1, wherein said fluid-tight means for driving said impellers comprises:

(a) an electrical motor including a drive shaft;

(b) a fluid tight motor casing having at least one air inlet and one air outlet, (c) an air blower for blowing air over said motor driven by said drive shaft and disposed between said air inlet and air outlet, wherein said air inlet and outlet are in communication with air.

9. An aerator device as in claim 8, wherein said motor includes a casing including cooling fins.

10. An aerator device as in claim 9, wherein said motor casing defines a taper generally surrounding said air blower and wherein said taper increases diameter in the direction of said air outlet and decreases diameter in the direction of said air inlet.

11. An aerator device as in claim 10, wherein said air blower is an impeller.

12. An aerator device as in claim 8, wherein said drive shaft extends from said motor into said pump casing, and wherein said first impeller, said second impeller, and said air blower are disposed upon said drive shaft.

* * * * *